US006309226B1

(12) United States Patent
Nakatani

(10) Patent No.: US 6,309,226 B1
(45) Date of Patent: Oct. 30, 2001

(54) ELECTRICAL CONNECTION BOX

(75) Inventor: Eiji Nakatani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/376,019

(22) Filed: Aug. 19, 1999

(30) Foreign Application Priority Data

Aug. 19, 1998 (JP) ..... 10-232837
Dec. 22, 1998 (JP) ..... 10-364473

(51) Int. Cl.[7] ..... H01R 12/00
(52) U.S. Cl. ..... 439/76.2; 439/34
(58) Field of Search ..... 439/76.2, 34

(56) References Cited

U.S. PATENT DOCUMENTS 4,599,679 7/1986 Baader .
4,846,733 7/1989 Baisz et al. .
5,088,940 2/1992 Saito .
5,647,769 7/1997 Takeuchi .
5,755,579 * 5/1998 Yanase et al. ..... 439/76.2
5,795,193 8/1998 Yang .
5,823,798 * 10/1998 Zintler et al. ..... 439/76.2
5,928,004 * 7/1999 Sumida et al. ..... 439/76.2

FOREIGN PATENT DOCUMENTS 0405337 6/1990 (EP) .

OTHER PUBLICATIONS

European Search Report EP 99 11 6358.

* cited by examiner

*Primary Examiner*—P. Bradley
*Assistant Examiner*—Trac Nguyen
(74) *Attorney, Agent, or Firm*—Bierman, Muserlian and Lucas

(57) ABSTRACT

An electrical connection box having a housing with one or more electrical components therein. A plurality of holding chambers are in communication with the housing. A busbar, having a plurality of tab terminals thereon, is inserted into the holding chambers through an opening in the main case. Similarly, wire terminals, mounted on the ends of wires, are also inserted through the opening into the holding chambers. There are engagement pieces which secure the busbar and the wire terminals in the main case and housings whereby each of the holding chambers is capable of receiving and securing either the busbar or a wire terminal.

2 Claims, 11 Drawing Sheets

ELECTRICAL CONNECTION BOX

This Application claims the benefit of the priorities of Japanese 10-232837, filed Aug. 19, 1998 and Japanese 10-364473, filed Dec. 22, 1998.

The present Invention is directed to an electrical connection box intended primarily for installation in the engine compartment of an automobile.

BACKGROUND OF THE INVENTION

Electrical connection boxes are used to hold various electronic devices (e.g. fuses) and also serve as connection junction points. In this type of connection box, there are two methods by which the electrical connection is made with the parts mounted in the housing. One such method consists of the use of a busbar having tab terminals. Alternatively, such connections are made using a combination of wires having solderless wire terminals and the busbar. Depending upon the nature of the circuitry, the foregoing methods are used selectively.

With reference to FIGS. 10 and 11, electrical connection boxes 101, 201, having different internal shapes, are used depending upon the particular construction method. However, the external shapes of connection boxes 101, 201 are identical.

As shown particularly in FIG. 10, main case 102 of connection box 101 is provided with a plurality of projecting housings 103. A plurality of partitions 105 divides inner wall 104 into a corresponding number of holding chambers 106. In those holding chambers 106 which have no housings 103 above them, engagement pieces 107 project from inner walls 104. Busbar 108 (shown in broken lines) is formed as a flat plate and carries five upwardly projecting tab terminals 109. Busbar 108 and tab terminals 109 are held in holding chambers 106. There are two openings 110 on busbar 108 which are aligned with engagement pieces 107.

When busbar 108 is inserted into holding chambers 106 from below main case 102 (as shown in FIG. 10), a portion of engagement piece 107 engages opening 110 of busbar 108. As a result, busbar 108 is reliably and firmly mounted in the desired position within connection box 101. Thereafter, the lead terminals of fuses (not shown) are inserted into tab terminals 109 of busbar 108 from above (as shown in FIG. 10) housing 103. This completes the electrical connection between the fuses and busbar 108.

The connection box as shown in FIG. 11 is typical of the second method. In this embodiment, wire terminals 213, mounted on the ends of wires 212, can be inserted into the two holding chambers 206 on the right as shown in FIG. 11. Also, busbar 209 is inserted from below so that its three tab terminals 210 project into the corresponding three holding chambers 206 on the left of the Figure. Busbar 209 is a flat plate wherein openings 211 are aligned with corresponding engagement pieces 207. Approximately semi-circular openings 214, on wire terminals 213, are at positions corresponding to engagement pieces 208.

Busbar 209 is inserted into holding chambers 206 from below (as shown in FIG. 11) main case 202. Engagement pieces 207 engage openings 211, thereby mounting the busbar in the connection box at the desired position. Upon insertion of wire terminals 213 into holding chambers 206 (also from below as shown in FIG. 11), engagement pieces 208 engage openings 214 of terminals 213. Thus, wire terminals 213 are mounted at the desired position in the connection box. The lead terminals of fuses (not shown) are inserted from above (as shown in FIG. 11) housing 203 into tab terminals 210 and wire terminals 213. In this manner, the electrical connection between the fuses on the one hand and busbar 209 and wires 212 on the other is established.

Since connection boxes of the type just described are made with various electronic parts mounted in the housings, it is necessary to design them in accordance with the desired circuitry and the method of connection used. Since the internal designs are different for the two methods, a single connection box cannot be used for both purposes. It is, of course, desirable to be able to have only a single form of the connection box as this provides substantial cost savings in stocking, handling, and assembly.

SUMMARY OF THE INVENTION

It is an object of the present Invention to provide a single electrical connection box which is suitable for connecting the electrical parts with the busbars and wires, thereby effecting desirable cost savings. To that end, the present Invention is a connection box wherein the holding chambers are adapted to receive either the tab terminals on the busbar or the wire terminals on the wires.

The electrical connection box includes a housing having one or more electrical components therein, and a plurality of holding chambers in communication therewith. There are openings in the housing remote from the tab terminals through which the busbar is inserted. In addition, one or more wire terminals, each mounted on an end of one of the wires, are also inserted through the openings.

There is at least one first engagement piece in a corresponding number of the holding chambers which engage the busbar when it is inserted. Also, there is at least one second engagement piece in other of the holding chambers which engages the wire terminals. The holding chambers are interconnected with each other adjacent the remote openings. As a result, electrical contact is established and maintained between the electrical components and the busbar and/or wire. Each of the holding chambers is capable of receiving either one of the tab terminals on the busbar or one of the wire terminals.

In a preferred form of the Invention, the individual holding chambers are each provided with a locking piece on the inner wall thereof. This locking piece is adapted to engage either the busbar or the wire terminals. In this fashion, any arrangement of the busbar and wires can be accommodated without the necessity of providing more than one connection box.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
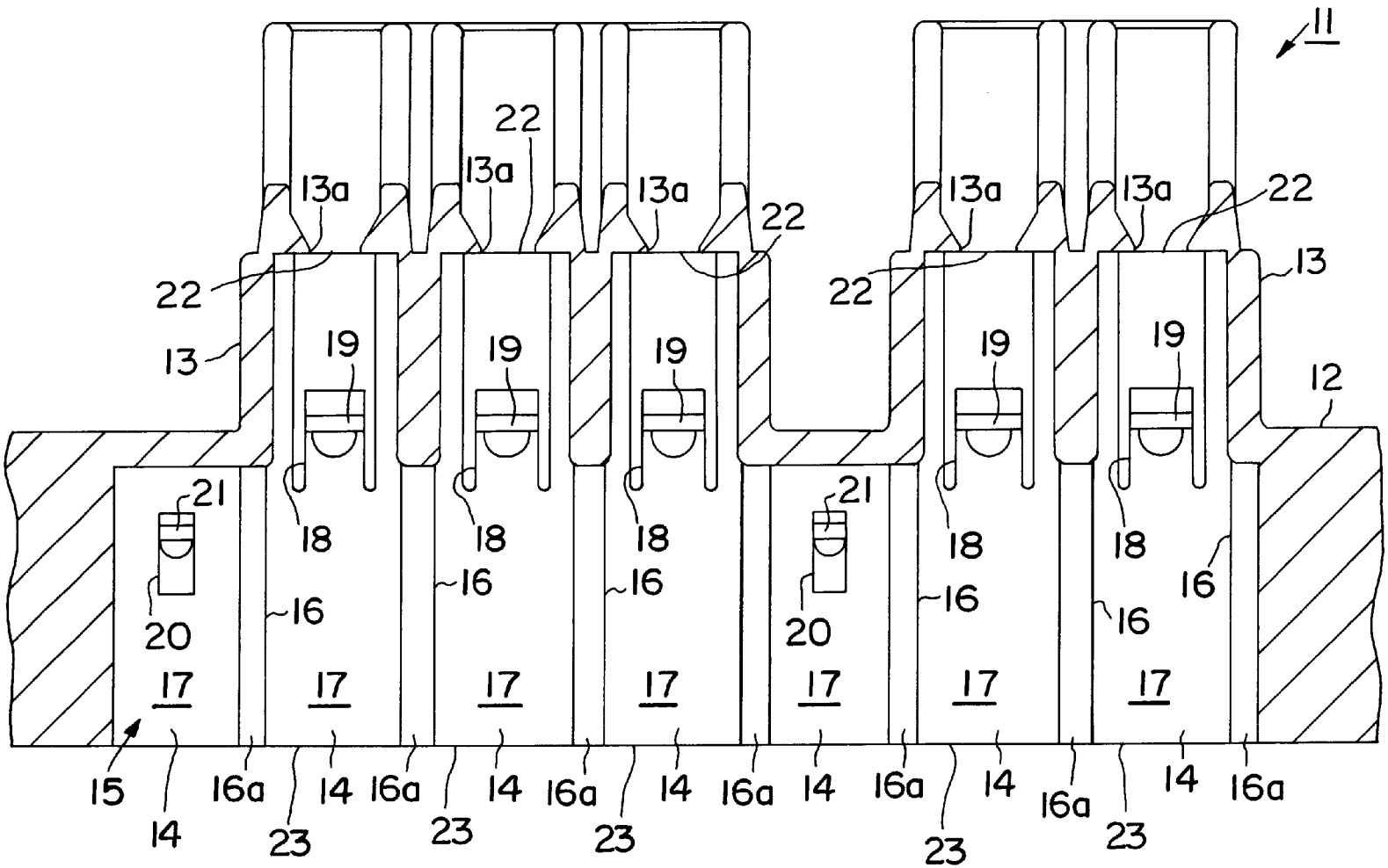
FIG. 1 is a front elevation, partly in section, of the connection box in accordance with the present Invention.
Figure 2:
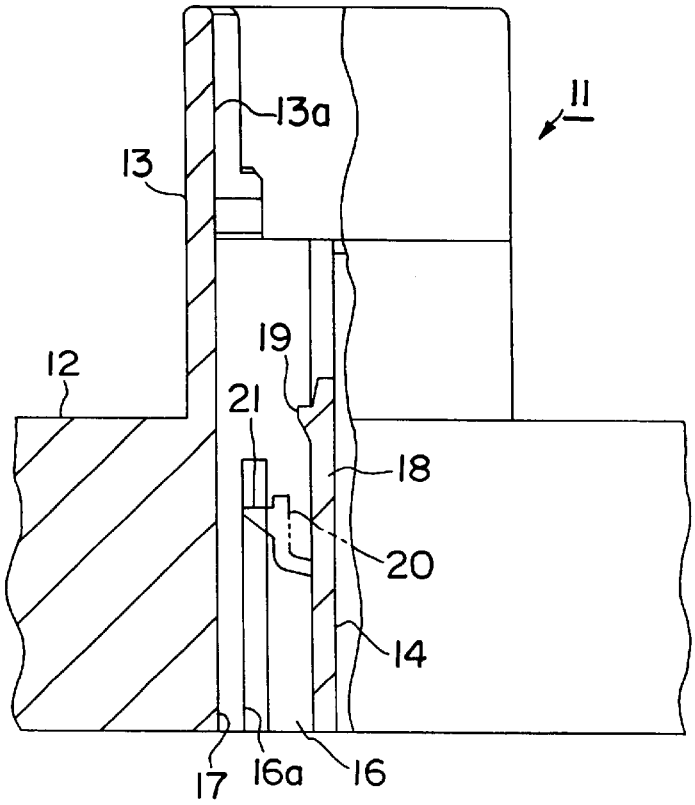
FIG. 2 is a fragmentary side elevation, partly in section, of the connection box of FIG. 1.
Figure 3:
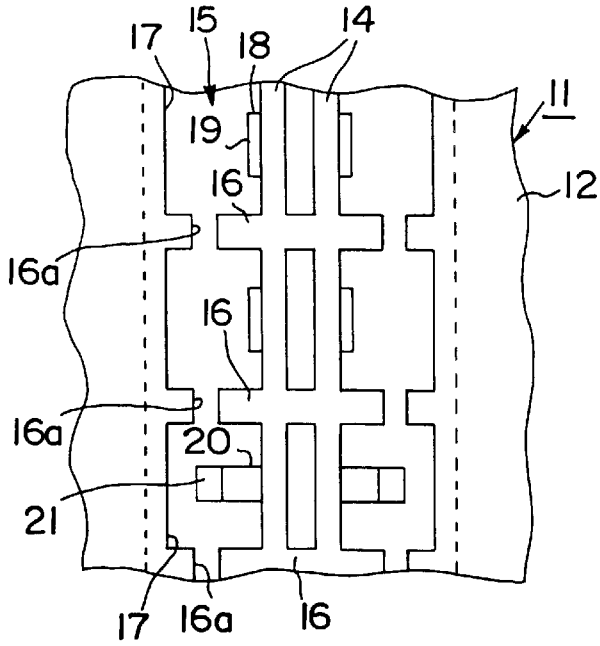
FIG. 3 is a fragmentary bottom view of the connection box of FIG. 1.

As shown in FIGS. 1 to 8, electrical connection box 11, of synthetic resin, includes main case 12 and a plurality of housings 13 which project therefrom. Housings 13 are preferably generally cylindrical in cross-section and have open upper ends 22 and lower ends 23. Holding section 15, having inner wall 14, is divided into holding chambers 17 by partitions 16. Insertion openings 13*a* are located at upper ends 22. Slits 16*a* are provided in partitions 16, near lower ends 23, thereby interconnecting adjacent holding chambers 17. First engagement pieces 20 include engagement projections 21 which are adapted to engage busbar 31 through busbar openings 33. In addition, second engagement pieces 18 carry terminal engagement projections 19 which engage wire terminals 52. It has been found advantageous to form second engagement pieces 18 by cutting and bending a section of inner wall 14. First engagement pieces 20 are located in those holding chambers 17 which do not have housing 13 above them.

Figure 4:
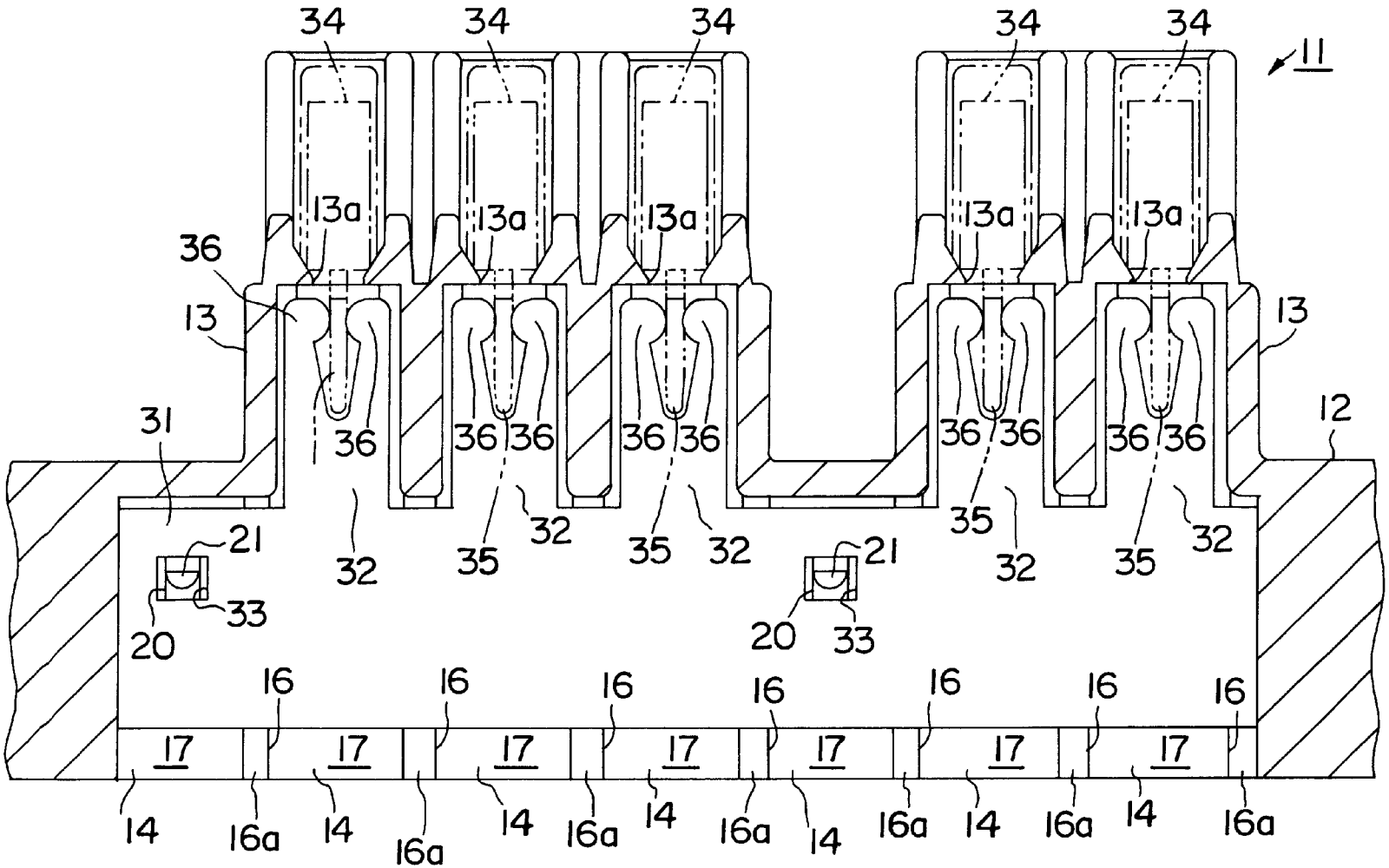
FIG. 4 is a view, similar to that of FIG. 1, of the connection box with the busbar in place.

As shown in FIG. 4, busbar 31 is inserted through the bottom of main case 12. Tab terminals 36 project into housings 13 and are adapted to receive—and make electrical contact with—leads 35 of fuses 34. Busbar 31 is retained in main case 12 by first engagement piece 20 and busbar engagement projection 21 which enters busbar opening 33. As can best be seen in FIG. 5, busbar 31 is spaced apart from inner wall 14.

Figure 6:
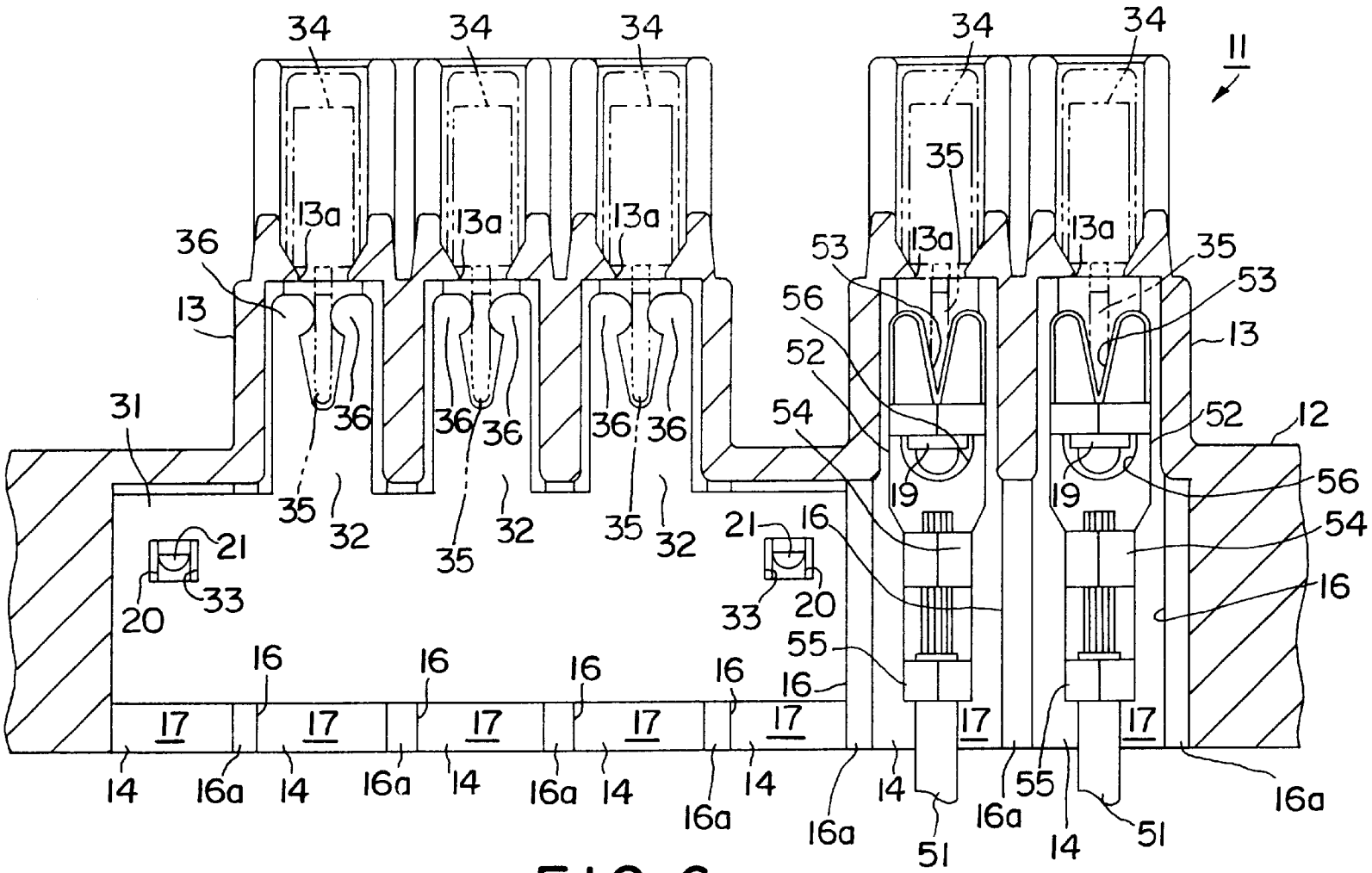
FIG. 6 is a connection box, similar to that of FIG. 4, having both a busbar and wire terminals therein.
Figure 7:
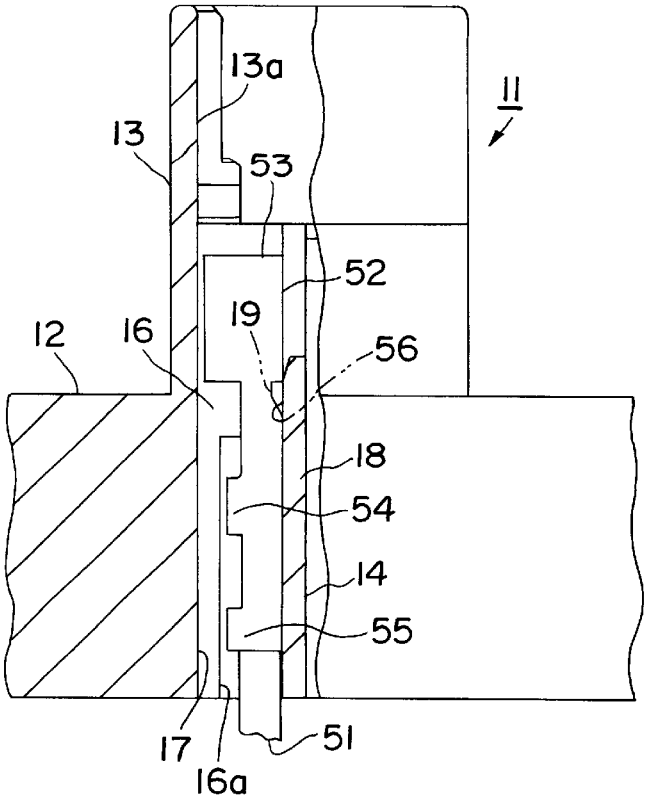
FIG. 7 is a side elevation, partly in section, showing the wire terminal in place.

A combination of the busbar and wire terminals is shown in FIGS. 6 and 7. In the device shown in these Figures, box 11 houses the connection between busbar 32 and wires 51, on the one hand, and fuses 34 on the other. Wire terminals 52 are attached to wires 51 by central crimping sections 54 and base crimping sections 55. Substantially semi-circular opening 56 is aligned with second engagement projection 19 to secure wire terminals 52 in holding chambers 17. Leads 35 of fuses 34 are introduced through insertion openings 13*a* into fuse insertion sections 53 of wire terminals 52. This establishes the electrical connection between fuses 34 and wires 51.

Figure 5:
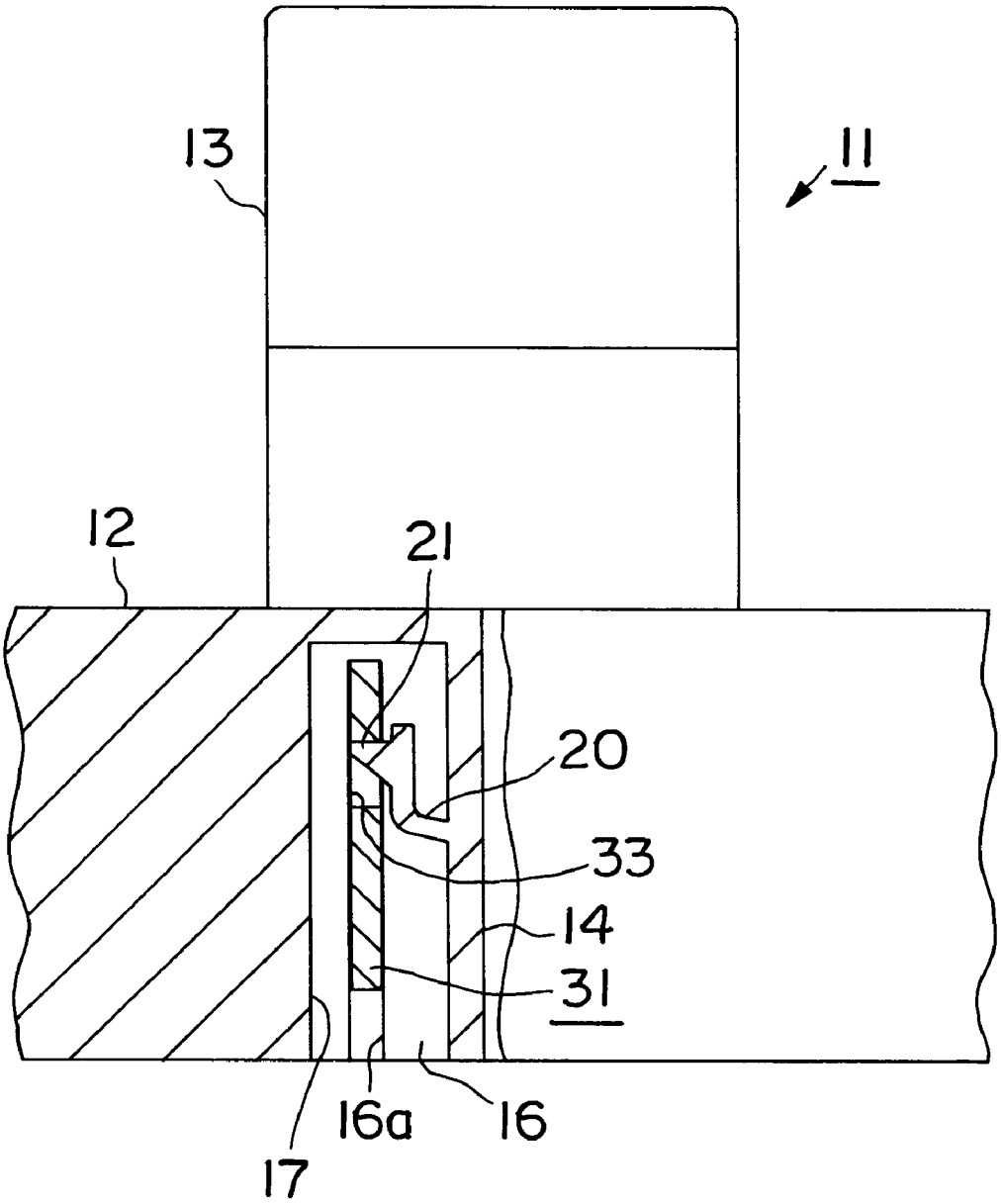
FIG. 5 is a fragmentary side elevation, similar to that of FIG. 2, of the connection box of FIG. 4.

In connection box 11, as shown in FIGS. 4 and 5, busbar 31 is provided with five tab terminals 32. Busbar 31 is inserted from below through slits 16*a* into holding chambers 17. This permits busbar 31 to be reliably mounted at its predetermined position and provides electrical connections between the busbar and fuses 34.

Figure 8:
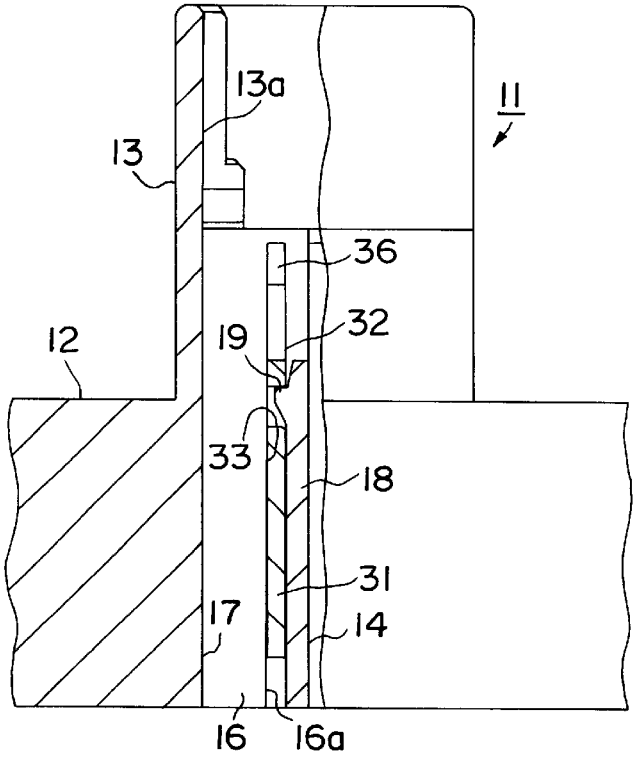
FIG. 8 is a side elevation, partly in section, showing the busbar in place.

Analogously, as shown in FIGS. 6 to 8, busbar 31 has three tab terminals 36. The busbar is also inserted from below main case 12 through slits 16*a* into holding chambers 17. In this connection box, two wires 51, carrying wire terminals 52, are also inserted into holding chambers 17 through slits 16*a*. Both busbar 31 and wire terminals 52 are thus mounted in their respective predetermined positions in the connection box.

A preferred form of the Invention is shown in FIG. 8. As can be seen by a comparison with FIG. 5, the locations of slits 16*a* are different from those in FIG. 5. They are next to inner walls 14 so that busbar 31 is immediately adjacent thereto. As a result, engagement pieces 20 are eliminated and busbar 33 is secured by locking projection 19. Moreover, locking projections 19 also serve to engage terminal openings 56 of wire terminals 52. As a result, either the busbar or the wire terminals can be inserted and secured in any of the holding chambers.

Figure 9:
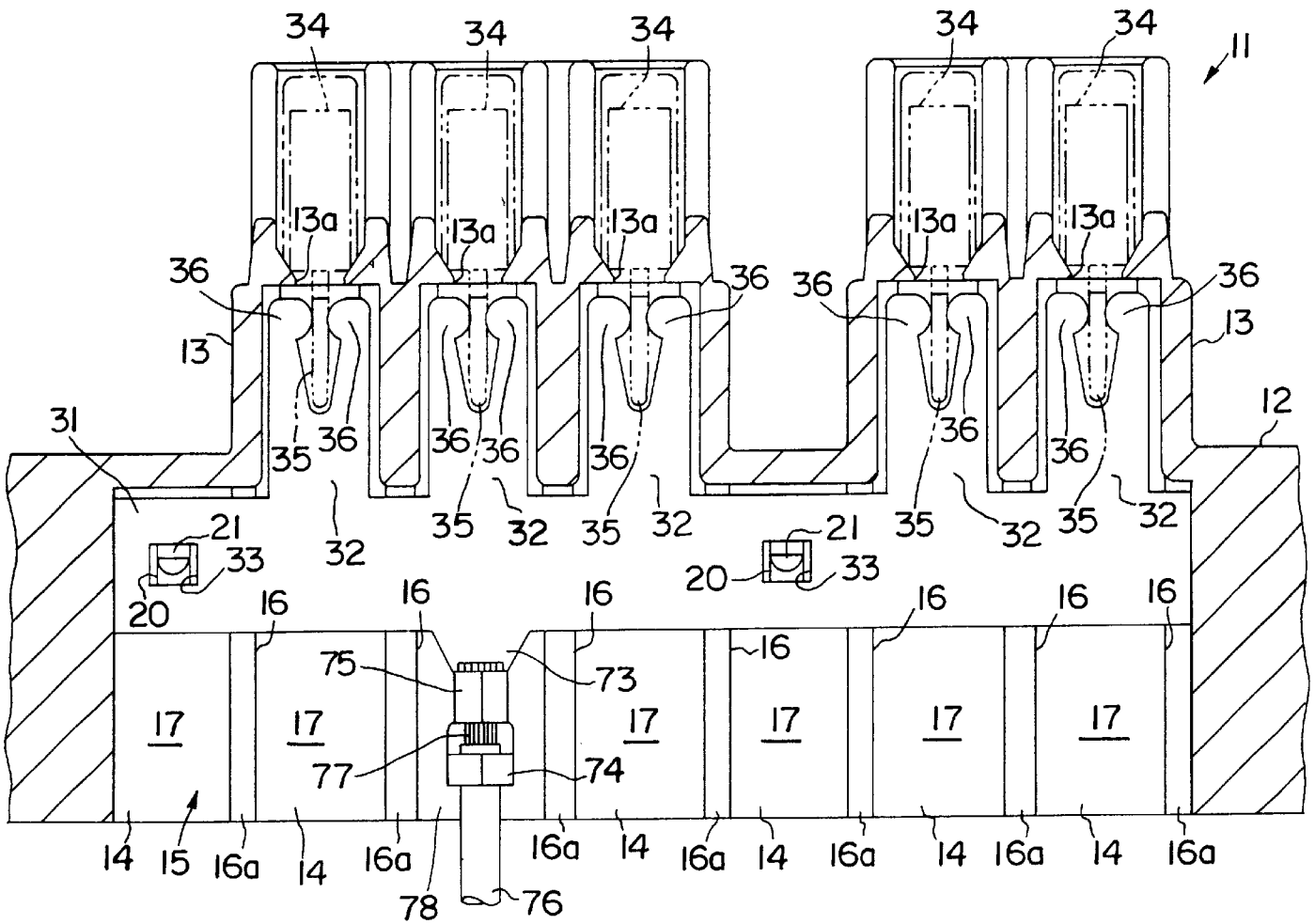
FIG. 9 is a view, similar to that of FIG. 4, showing a modification of the busbar/wire terminal combination.
Figure 10:
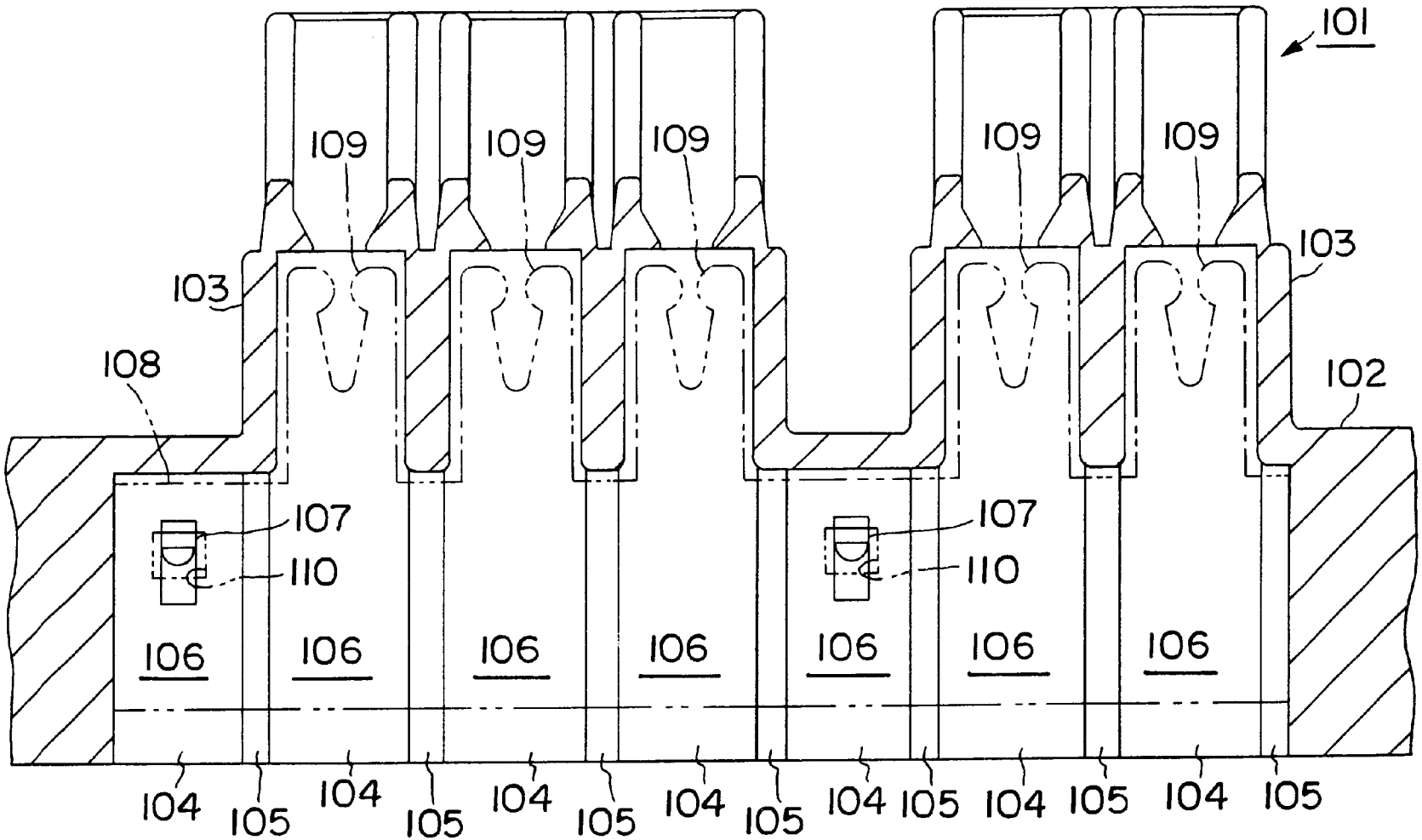
FIG. 10 is a view, similar to that of FIG. 4, of a prior art connection box.
Figure 11:
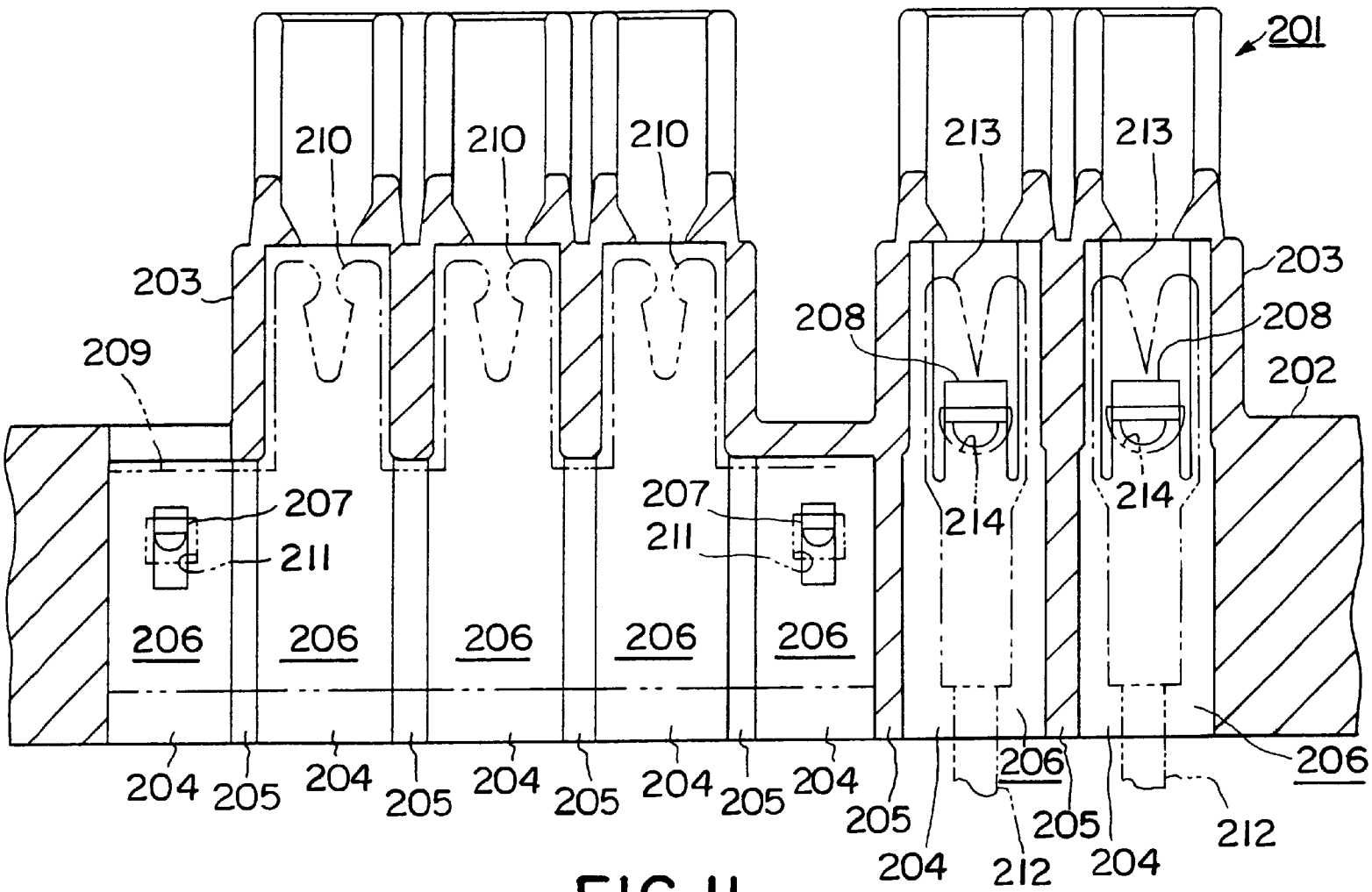
FIG. 11 is a view, similar to that of FIG. 6, of another prior art connection box.
Figure 12:
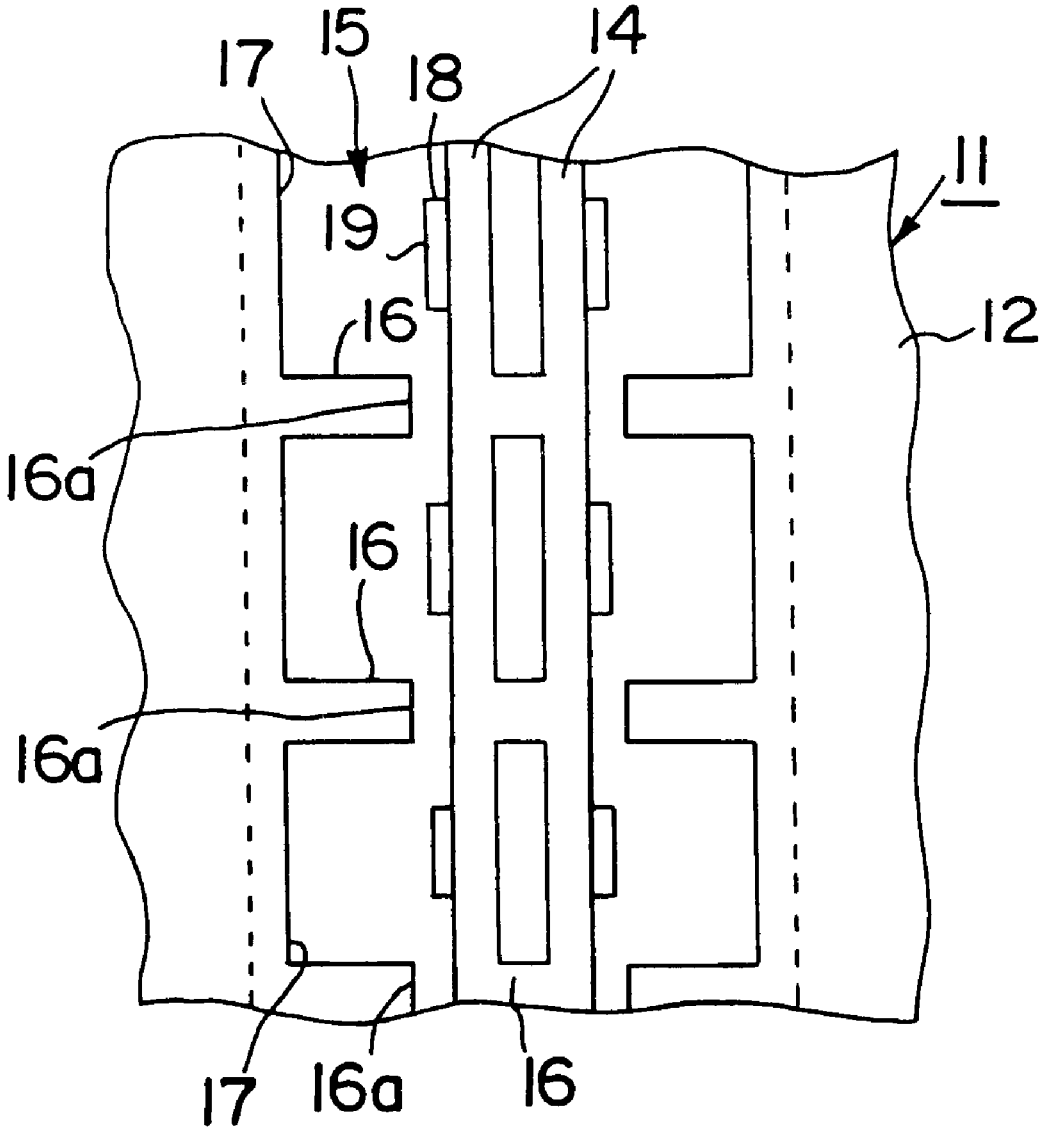
FIG. 12 is a top view of FIG. 8 without the busbar present.
Figure 13:
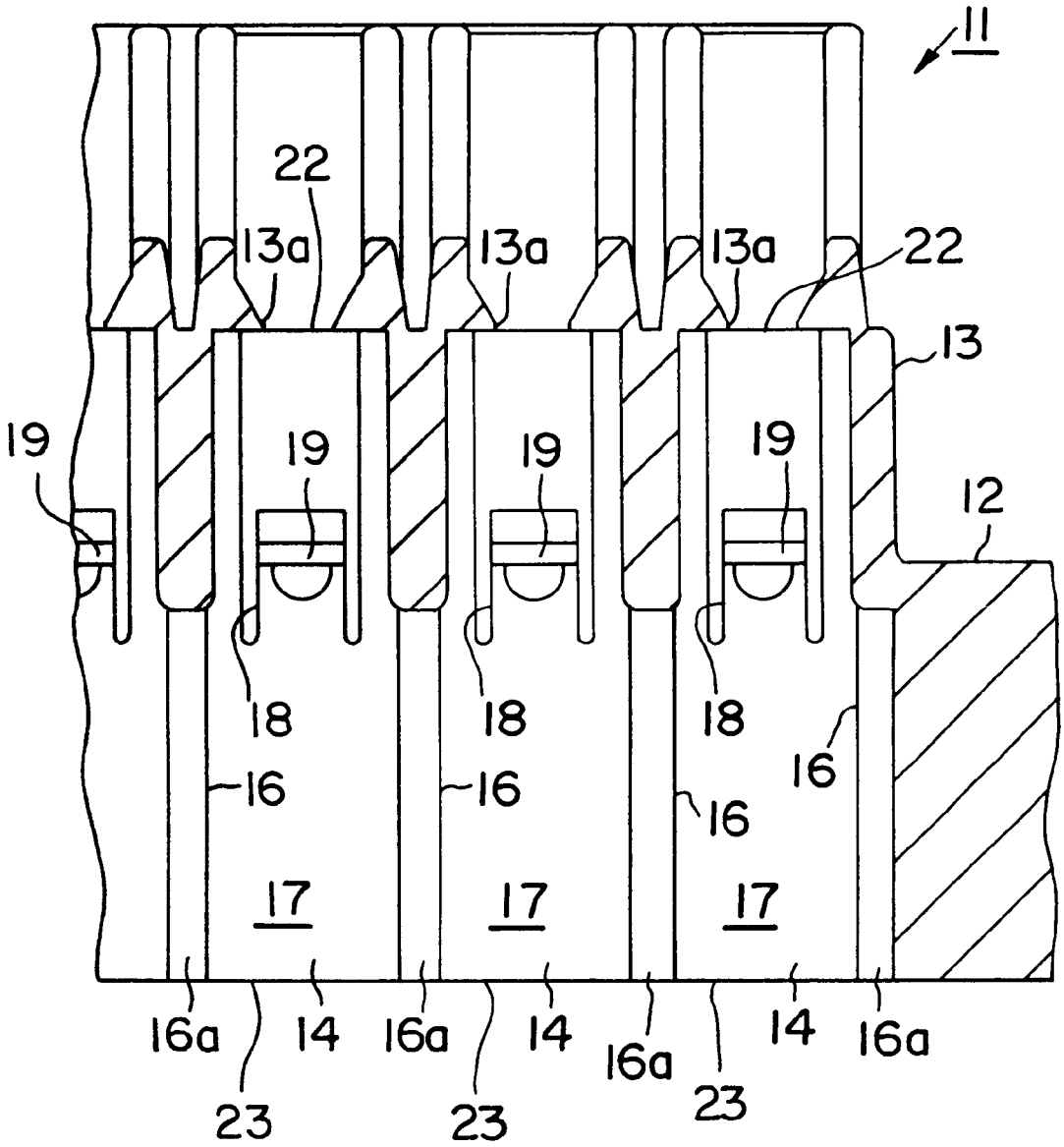
FIG. 13 is a front view of the connection box of FIG. 8.

A desirable form of the Invention is shown in FIG. 9. Most of the features are substantially the same as those previously described. However, in this case, busbar 31, in addition to the five tab terminals 32, is provided with tab 73 which extends toward the lower opening of holding section 15. Lower crimping section 74 and upper crimping section 75 are formed on tab 73. Power supply cable 76 is introduced into holding cavity 78, lower crimping section 74 grips the external surface of the cable, and upper crimping section 75 grips conductors 77, thereby securing the power supply cable in the cavity and establishing the desired electrical connection.

The present Invention provides second engagement pieces on the inner walls of the holding chambers. The engagement projections are adapted to secure either the busbar or wire terminals. The slits, which interconnect adjacent holding chambers, are perpendicular to the partition walls and located adjacent the bottom surface of the main case. As a result, the two different types of connectors can be inserted in varying combinations and locations using the same connection box.

It is of particular advantage if the form of the Invention as shown in FIG. 8 is adopted. In this case, first engagement piece 20 and projection 21 are eliminated completely, since the busbar is held by second engagement piece 18 and its corresponding engagement projection 19, thereby reducing the cost of the connection box. The Invention as shown in FIG. 9 has the added advantage of providing the crimping terminal as part of tab 73. Since this can all be stamped out of a single sheet of metal at the same time, further savings are accomplished. A separate crimping terminal is no longer needed and the cost thereof can be saved. Also, there is no opportunity for the terminal to fall off or get lost during the course of processing. Overall, the number of steps required to assemble the connection box is reduced and corresponding cost savings are achieved.

Although the present Invention has been described specifically, such modifications as would be apparent to the person of ordinary skill may be made without departing from the scope or spirit thereof. For example, the arrangement of the slits and busbar as shown in FIG. 8 could be applied to FIG. 1. This would achieve the same advantages in the latter structure. Although female tab terminals were shown on the busbars, male terminals could be substituted therefor. Also, the electrical parts were described as being fuses; however, it is also possible to substitute relays or any other such elements therefor.

Although only a limited number of specific embodiments of the present Invention have been expressly set forth, it is, nonetheless, to be broadly construed and not to be limited except by the character of the claims appended hereto.

What is claimed is:

1. An electrical connection box comprising a main case, a plurality of housing projecting from said main case and adapted for housing an electrical component therein, a plurality of holding chambers such that each of said housings is in communication with one of said holding chambers, openings in each of said holding chambers through which a busbar, having a plurality of tab terminals thereon, or at least one wire terminal, mounted on an end of at least one wire, are inserted, a slit between each of said holding chambers, said slit interconnecting adjacent holding chambers, said slit immediately adjacent an inner wall of each of said holding chambers, a locking piece on said inner wall of each of said holding chambers and adapted to engage both a tab terminal on a busbar or a wire terminal on an end of a wire, said busbar or said wire terminal having been inserted into said holding chambers through said openings, thereby making electrical contact between said electrical components and said busbar or said wire terminal.

2. The electrical connection box of claim 1 wherein adjacent said holding chambers are separated by parallel partitions extending from said opening toward said electrical component, slits in said partitions at right angles thereto.

* * * * *